United States Patent [19]

Simin et al.

[11] 4,227,657

[45] Oct. 14, 1980

[54] DEVICE FOR FEEDING YARN TO A KNITTING MACHINE

[76] Inventors: Solomon K. Simin, prospekt Nauki, 12, kv. 153; Georgy I. Kurganov, ulitsa Sofii Kovalevskoi, 4, kv. 183; Georgy N. Stark, ulitsa Dzerzhinskogo, 64, kv. 1; Jury S. Kuzovkov, Nevsky prospekt, 53, kv. 20; Arkady I. Ludar, Svetlanovsky prospekt, 99, korpus 1, kv. 154, all of Leningrad, U.S.S.R.

[21] Appl. No.: 8,872

[22] Filed: Feb. 2, 1979

[51] Int. Cl.[3] ..... B65H 51/20

[52] U.S. Cl. ..... 242/47.01; 66/132 R; 139/452; 242/47.12

[58] Field of Search ..... 242/47.01–47.13, 242/45, 47; 66/132 R, 132 T; 139/452

[56] References Cited

U.S. PATENT DOCUMENTS

| | | | |
|---|---|---|---|
| 3,243,975 | 4/1966 | Lawson et al. | 242/47.01 X |
| 3,377,824 | 4/1968 | Moyer | 242/47.01 X |
| 3,490,710 | 1/1970 | Muhlhausler | 242/47.01 |
| 3,827,645 | 8/1974 | Rosen | 242/47.01 X |
| 4,147,311 | 4/1979 | Jordan | 242/47.01 |

*Primary Examiner*—Stanley N. Gilreath
*Attorney, Agent, or Firm*—Lackenbach, Lilling and Siegel

[57] ABSTRACT

A device for feeding yarn to a knitting machine comprises a yarn guide and a drive pulley with a yarn feeding roller, mounted on a shaft for rotating said shaft. The yarn feeding roller is defined by two discs being provided, each of said discs, on the side facing the interior of the yarn feeding roller, with slots arranged symmetrically in relation to a plane perpendicular to the rotation axis of the yarn feeding roller. An elastic band runs between the discs in the respective opposing slots and forms the yarn feeding surface of the roller with a variable diameter. Spaced from the yarn feeding roller and mounted in a stationary position in relation thereto is a yarn guide in the form of a rod having its upper portion disposed at an angle to the rotation axis of the yarn feeding roller, and its lower portion disposed parallel to this axis for steady guiding yarn loops along the yarn feeding surface of the roller with a variable diameter.

3 Claims, 18 Drawing Figures

DEVICE FOR FEEDING YARN TO A KNITTING MACHINE

FIELD OF THE INVENTION

The present invention relates generally to the knitting machine industry, and more specifically, to a device for feeding yarn to a knitting machine.

The present invention may be particularly beneficial whenever it is desirable to produce knitted fabrics incorporating lastex, interlock and combined yarn weave patterns in various multifeed knitting machines with different levels of yarn consumption.

BACKGROUND OF THE INVENTION

In order to obtain the production of high-quality knitted fabrics, in today's knitwear manufacture it is essential that a specified amount of yarn required for stitch formation with strictly controlled yarn tension be fed to the needles of the knitting machines. Even the slightest yarn tension fluctuations may cause marked alterations in a stitch structure, which eventually result in the production of low-quality knitwear. Such yarn tension fluctuations may arise due to a variety of reasons, the major of which are as follows: a variation in the roll diameter, caused by the yarn turns being wound off and in the resistance of air as the diameter of the spool decreases; a variation in the level of friction between the yarn turns being wound off and the surface of the spool as a consequence of the decreased diameter of the spool; yarn nonuniformity, a variation in the coefficient of yarn friction, clogging of yarn guiding devices, variations in humidity and ambient air temperature, and a differing degree of wear of individual components of the knitting machines, etc.

The need for yarn tension stability has necessitated the development of devices for the feeding of yarn to the needles employing different operating concepts.

There are known a great deal of various devices for yarn feeding, in particular devices which provide for the positive feeding of yarn to the needles of knitting machines.

Known in the prior art is a device for guided feeding of yarn to a knitting machine (see U.K. Pat. No. 920527) comprising a roller, the surface of which is formed by pins mounted parallel to the axis of the roller in two flanges. The roller is driven by an endless band moving with a constant speed. The yarn being fed is trapped between the band and the pins of the roller.

A basic disadvantage of the aforementioned device consists in that the yarn is trapped between the roller pins and the band in an unstable manner, which leads to imparting yarn tension fluctuations to the knitting area and, therefore, results in a deteriorated stitch structure and uniformity of a knitted fabric, increased yarn ruptures and an reduced machine output.

Another essential disadvantage of the above device is the presence of one and the same yarn feeding speed in diverse knitting systems, which consequently limits the production potentialities of the machines.

Also known in the prior art is a device, wherein in order to expand the production potentialities of a knitting machine, yarn feeding rollers are arranged in a number of rows in height, with the rollers of each row being embraced by an individual drive band. The drive bands of each row move with different speeds and, therefore, yarn feeding to diverse knitting systems of the machine is also accomplished with different speeds.

This prior art device, like the one considered hereinabove, is not capable of fully compensating for yarn tension fluctuations, and the provision of yarn feeding to the diverse knitting systems of the machine accomplished at different speeds is made at the expense of considerable design intricacy, increased overall dimensions, which involves a substantial inconvenience when reloading, charging or changing yarn for the machine, as well as a reduced machine output associated therewith.

These disadvantages are partially obviated in a device comprising a yarn feeding roller provided with a single band drive having interchangeable pulleys for each yarn feeding device, and a yarn guide designed in the form of an inclined ring looping around the yarn feeding roller and having an inner diameter corresponding to the diameter of said yarn feeding roller (see F.R.G. Pat. No. 2,365,251).

The above device insures yarn feeding with variable speeds to diverse knitting systems of the machine by means of the selection of a suitable interchangeable pulley for each yarn feeding device. Such a device includes a set of nine interchangeable drive pulleys. When knitting various weave patterns, on each yarn feeding device there is mounted one of the nine drive pulleys. This device provides an opportunity for winding yarn on the rotating roller while it is being continuously consumed by the needles of the knitting machine in a concurrent manner. The placing of the yarn turns being wound on the yarn feeding roller surface is effected by means of setting the yarn turns downward with the aid of the inclined ring of the yarn guide. The roller is driven by an endless perforated belt.

Such a design of the yarn feeding device has a disadvantage consisting in the multiplicity of interchangeable pulleys, which is characteristic of the complexity and imperfection of the above yarn feeding device and its high materials consumption. Furthermore, the design incorporating the use of interchangeable pulleys of different diameters makes it necessary to install sliding idler pulleys intended to provide a required degree of belt tension, which additionally complicates both the structure and operation of the knitting machine.

Another disadvantage of the device lies in that the yarn guide is made dependent on the diameter of the yarn feeding roller and, hence, a change in the diameter of the roller causes a change in the diameter of the ring of the yarn guide. Such a design of the yarn guide also complicates the yarn feeding device in terms of its design and brings about some inconvenience in operating the knitting machines.

Still another tangible disadvantage of this prior art device consists in that it has a considerable mass of rotating components, as well as in that the yarn guide is conceived in the form of a rotating ring, which causes significant dynamic loads and the frequent yarn ruptures associated therewith.

SUMMARY OF THE INVENTION

It is an object of the present invention to simplify the design of a yarn feeding device, to increase its operational reliability and to reduce the bulk of its rotating components.

With these and other objects in view, there is provided a yarn feeding device comprising a yarn guide, a drive pulley with a yarn feeding roller mounted on a shaft, and the yarn feeding roller being defined by two discs mounted on the shaft. Each of the discs, on the side inwardly facing the yarn feeding roller, being provided with slots arranged symmetrically in relation to a plane perpendicular to the rotation axis of the yarn feeding roller. An elastic band positioned between the discs in the respective opposing slots forming the yarn feeding surface of the roller with a diameter variable on moving the band along said slots of said discs. The yarn feeding roller is spaced apart or removed from a yarn guide mounted in a stationary position in relation thereto and is in the form of a rod having its upper portion disposed at an angle to the rotation axis of the yarn feeding roller and its lower portion is disposed parallel to this axis, to provide thereby steady guiding of yarn windings along the yarn feeding surface of the roller with a variable diameter.

The yarn feeding roller is in the form of discs with the elastic band being arranged in the respective opposing slots so as to ensure a lighter structure of the yarn feeding roller which reduces the dynamic loads exerted on the yarn in starting and stopping of the knitting machine and, therefore, results in an improved operational reliability of the yarn feeding device.

Provision of the slots in each of the discs on the side inwardly facing the yarn feeding roller enables the diameter of the roller to be varied by moving the elastic band to the respective opposing slots of the discs and, therefore, the speed of yarn being fed to various knitting systems of the machine can be readily changed. The variable-diameter yarn feedig roller design simplifies the structure of the device and its operation, as well as reduces the materials consumed in use of the device.

The symmetrical arrangement of the slots on the discs, relative to the perpendicular rotation axis of the yarn feeding roller enables a cylindrical shape to be attached to the yarn feeding surface of the roller, which is an important condition for maintaining the stability of yarn feeding speed and uniform of yarn tension.

The yarn guide designed in the form of a rod mounted in a stationary position in relation to the yarn feeding roller and spaced at some distance therefrom makes it possible to utilize the same yarn guide for yarn feeding rollers with different diameters without the need for any re-adjustments thereof, which greatly simplifies the structure and operation of the device.

The design featuring the yarn guide with its upper portion disposed at an angle to the rotation axis of the yarn feeding roller, and its lower portion disposed parallel to this axis contributes to an increase in yarn tension uniformity due to smooth running of yarn turns thereupon without overlapping. Along with it, the upper portion of the yarn guide is disposed at an angle to the rotation axis of the yarn feeding roller, sets the yarn turns downward, while the lower portion thereof, disposed parallel to this axis, contributes to compacting the turns.

It is desirable to make the slots on the discs in the form of concentrically arranged annular grooves.

Such a design of the slots enables a certain diameter of the yarn feeding roller to be set and thus ensures the desirable constant speed of yarn feeding while manufacturing knitted fabrics with any yarn weave patterns.

According to another embodiment of the invention, it is advantageous to make the slots in the form of helical grooves with a spacing between turns on either of the discs of about 0.3 to 0.5 mm.

The slots designed in the form of a helical groove enable the diameter of the yarn feeding roller to be smoothly varied or changed and thus to evenly change the speed of yarn feeding by turning the discs of the yarn feeding roller relative to each other.

The helical slot having a pitch of not more than proximate a circular cylinder shape, which enables to gain the uniformity of tension and the desirable speed of yarn feeding. The helical slot having a pitch of not less than 0.3 mm enables to gain firm splitters between the turns of the helical slot.

The foregoing objects and advantages of the proposed invention will become more readily apparent from the following detailed description of its embodiments with reference to the accompanying drawings.

DESCRIPTION OF THE PREFERRED EMBODIMENTS OF THE INVENTION

Figure 1:
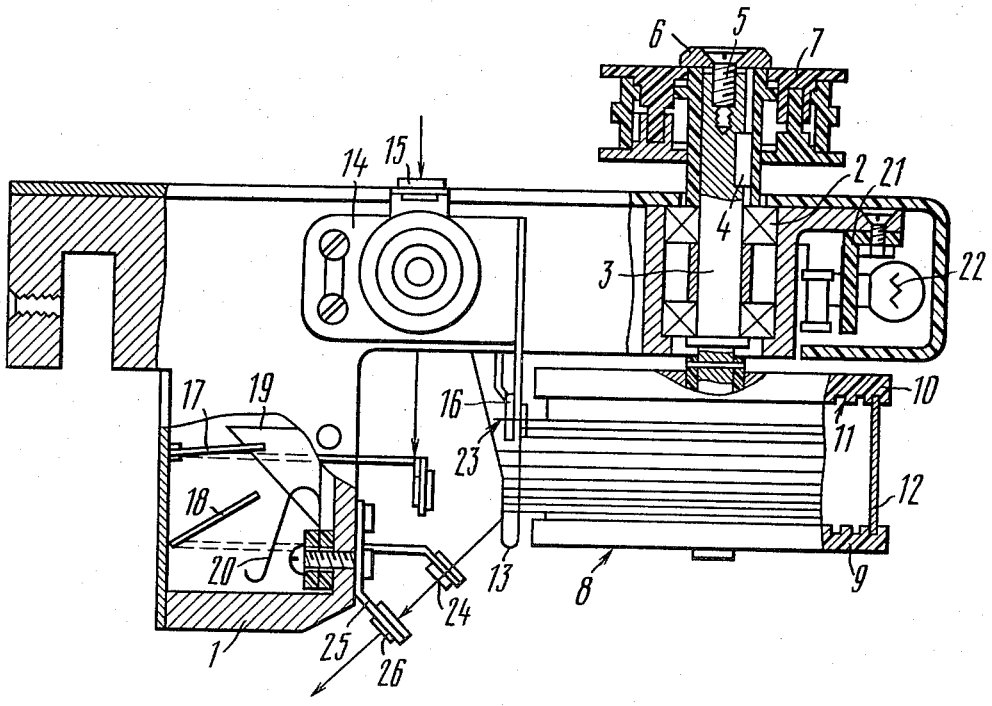
FIG. 1—illustrates a front view, partly in section of the novel device for feeding yarn to a knitting machine.

As best shown in FIG. 1, the device for yarn feeding comprises a housing 1, wherein on ball bearings 2 there is mounted a shaft 3 having a drive pulley 7 set up thereon by means of a key 4, a screw 5 and a washer 6. On the lower portion of the shaft 3, there is mounted a yarn feeding roller 8 defined by two discs 9 and 10 assembled on the shaft 3. Each of the discs, on the side inwardly facing the yarn feeding roller 8, is provided with slot 11 arranged symmetrically in relation to a plane perpendicular to the rotation axis of the yarn feeding roller 8. An elastic band 12 runs between the discs 9 and 10 in the respective opposing slots 11 and forms the yarn feeding surface of the roller 8 with a diameter variable on moving the elastic band 12 along said slots 11. Spaced away from the yarn feeding roller 8 and mounted on the housing 1 in a stationary position in relation to the yarn feeding roller 8 is a yarn guide 13. The yarn guide 13 is in the form of a rod having its upper portion disposed at an angle to the rotation axis of the yarn feeding roller 8 and its lower portion disposed parallel to this axis to provide thereby steady guiding of yarn windings over the yarn feeding surface of the roller 8 with a variable diamter. On the external wall of the housing 1 there is mounted a yarn tensioner 14 with a bushing 15 intended for directing yarn on its entry to the yarn tensioner 14, and a bushing 16, intended for directing yarn on its exit from the yarn tensioner 14. Arranged inside the housing 1 are levers 17 and 18, which are connected, respectively, to contact plates 19 and 20 and intended for shutting down the machine on yarn path malfunctions. In the front portion of the housing 1 on an arm 21, there is mounted a pilot lamp 22 electrically connected to the contact plates 19 and 20. The levers 17 and 18 are provided, respectively, with bushings 23 and 24 passing through the yarn while winding it on and off the yarn feeding roller 8. The housing 1 has an arm 25 rigidly fixed thereto, which carries a bushing 26 for feeding the yarn to the needles of the knitting machine. By means of a screw 27 the housing 1 (FIG. 2) is attached onto a ring 28 mounted on the knitting machine by means of arms 29. The yarn feeding rollers 8 are brought in rotation from a speed variator 30 and a pulley 31, which are interconnected by a wedge belt 32. The pulley 31 is rigidly connected to a pulley 33 transmitting rotation with the help of a perforated belt 34 to the drive pulleys 7 and further to the yarn feeding rollers 8. To ensure proper tension of the belt 34 there are idler pulleys 35 which are mounted on arms 36 and are slidable therealong.

Figure 3:
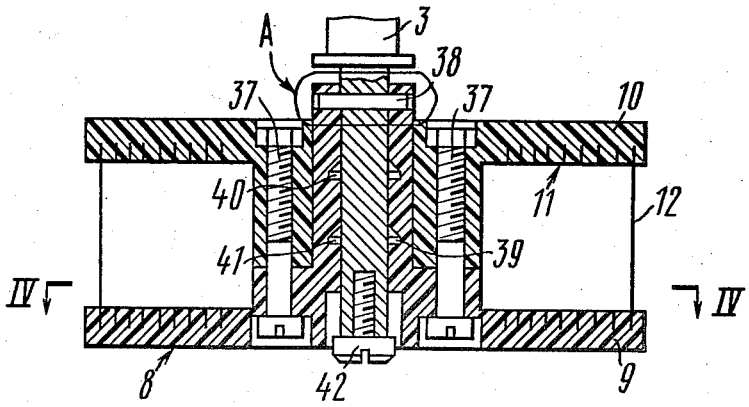
FIG. 3—is a sectional view of a yarn feeding roller illustrated in FIG. 1, incorporating annular slots, and shown as an enlarged view.
Figure 4:
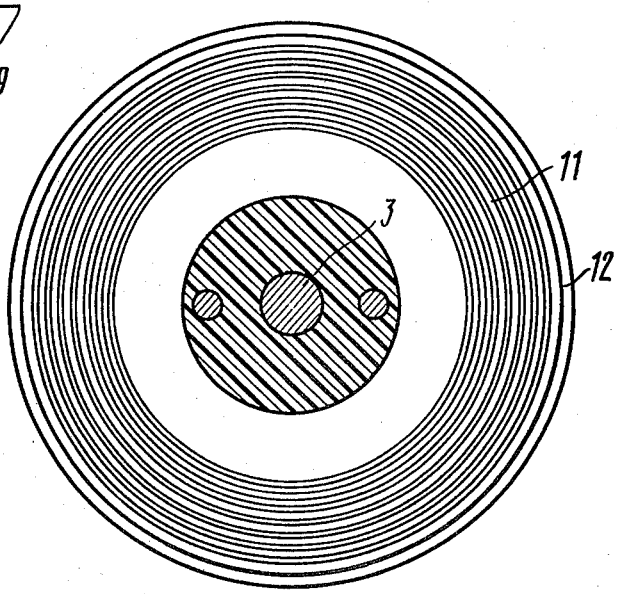
FIG. 4—is a sectional view taken along the line IV—IV of FIG. 3.

According to one embodiment of the device for yarn feeding, the slots 11 (FIGS. 3 and 4) are designed in the form of annular grooves cut concentrically with respect to the shaft 3 on the discs 9 and 10, and the annular grooves symmetrically located on the discs 9 and 10 in relation to a plane perpendicular to the rotation axis of the yarn feeding roller 8.

Figure 5:
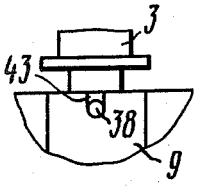
FIG. 5—is a fragmentary view of unit A shown in FIG. 3.

The discs 9 and 10 are made of a light material, e.g. plastic material, and are connected together by screws 37. Rotation is transmitted to the yarn feeding roller 8 from the shaft 3 by means of a pin 38. On the shaft 3 there is mounted a ring spring 39, while the disc 9 is provided with two annular grooves 40 and 41 for receiving the ring spring 39 when shifting the yarn feeding roller 8 from an operating to a non-operating position. In the lower portion of the shaft 3 there is a screw 42, which, together with the spring 39, retains the yarn feeding roller 8 on the shaft 3 in the non-operating position. The pin 38 (FIG. 5) is located in a slot 43 made in the disc 9 with its top open for freely moving the yarn feeding roller 8 downward.

Figure 6:
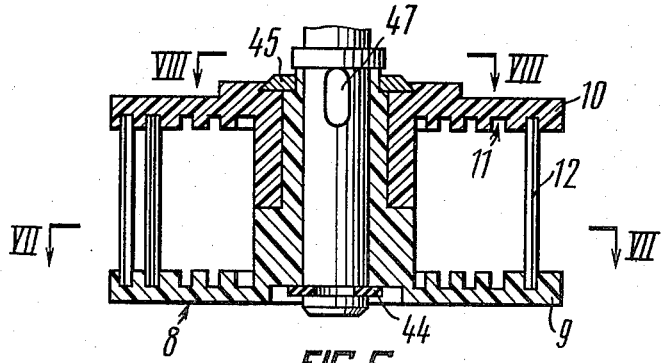
FIG. 6—is a sectional view of a yarn feeding roller illustrated in FIG. 1, incorporating helical slots, and shown as an enlarged view.
Figure 7:
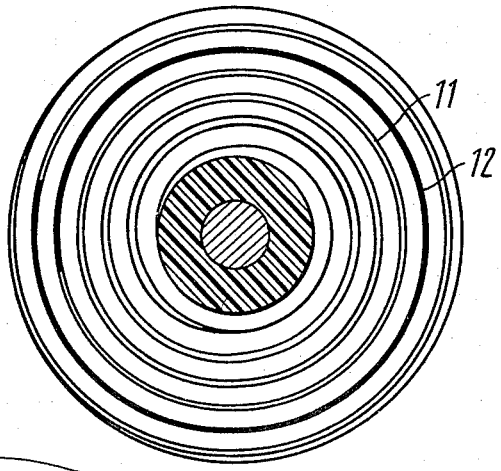
FIG. 7—is a sectional view taken along the line VII—VII of FIG. 6.
Figure 8:
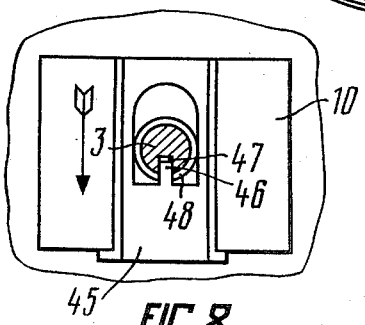
FIG. 8—is a sectional view taken along the line VIII—VIII of FIG. 6.

According to another embodiment of the device for feeding yarn, the slots 11 (FIGS. 6 and 7) are designed in the form of helical grooves arranged symmetrically on the discs 10 and 9 with respect to a plane perpendicular to the rotation axis of the yarn feeding roller 8. The turns of the helical grooves should be spaced apart within 0.3 to 0.05 mm. The lower limit is dictated by the requirement on strength of the splitter between the slots 11, while the upper limit is dictated by the necessity of imparting to the yarn feeding surface of the roller 8 the shape of a circular cylinder, ensuring uniform yarn feeding speed and yarn tension. To prevent the yarn feeding roller 8 (FIG. 6) from moving downward, a spring washer 44 is mounted on the lower end of the shaft 3. A slider 45 (FIGS. 6 and 8) is mounted on the disc 10 and has a lug 46, which can fit into a slot 47 arranged on the shaft 3, and into a slot 48 arranged on the disc 9.

Figure 9:
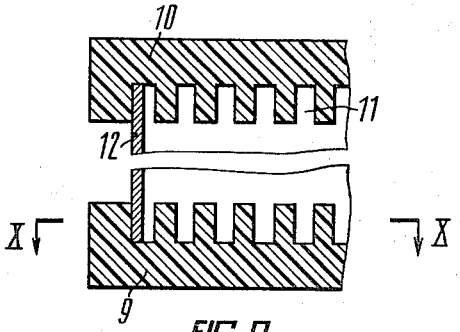
FIG. 9—is an enlarged front view in section of a yarn feeding roller illustrated in FIG. 3, having the maximum diameter of the yarn feeding surface.
Figure 10:
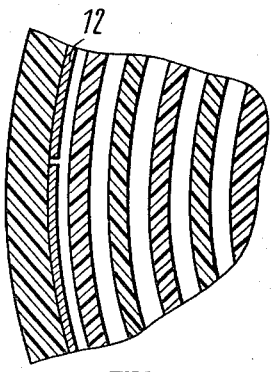
FIG. 10—is a fragmentary sectional view taken on the line X—X of FIG. 9.
Figure 11:
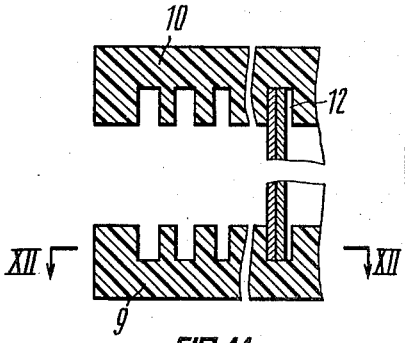
FIG. 11—is a view similar to that of FIG. 9 and showing the yarn feeding roller illustrated in FIG. 3, but having the minimum diameter of the yarn feeding surface.
Figure 12:
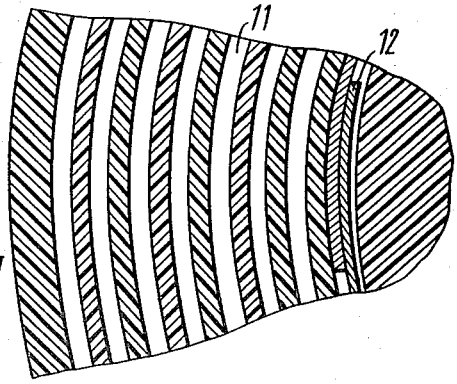
FIG. 12—is a fragmentary sectional view taken on the line XII—XII of FIG. 11.
Figure 13:
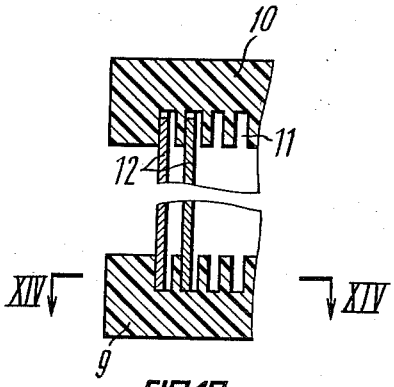
FIG. 13—is an enlarged front view in section, of a yarn feeding roller illustrated in FIG. 6, having the maximum diameter of the yarn feeding surface.
Figure 14:
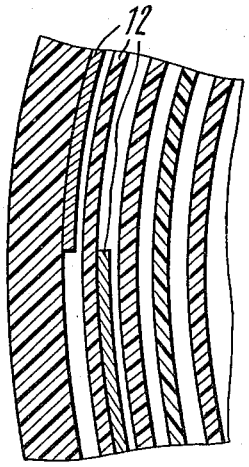
FIG. 14—is a fragmentary sectional view taken along the line XIV—VIX of FIG. 13.
Figure 15:
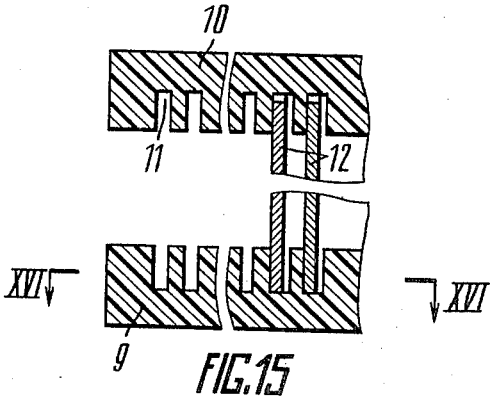
FIG. 15—is a view similar to that of FIG. 13 and showing the a yarn feeding roller illustrated in FIG. 6, but having the minimum diameter of the yarn feeding surface.
Figure 16:
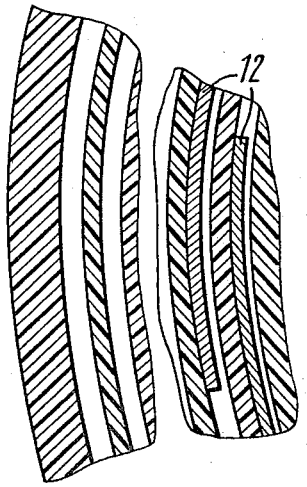
FIG. 16—is a fragmentary sectional view taken on the line XVI—XVI of FIG. 15.
Figure 17:
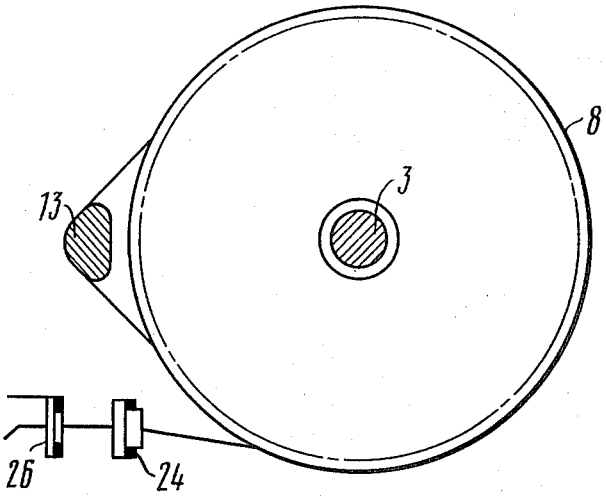
FIG. 17—is a top plan view of a yarn feeding roller with a yarn guide illustrated in FIG. 1.
Figure 18:
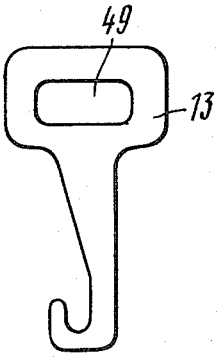
FIG. 18—is an enlarged view of the yarn guide illustrated in FIG. 1.

In FIGS. 9 and 10, there is shown the position of the elastic band in the embodiment in which the yarn feeding roller incorporates the annular slots 11 and has the maximum diameter of its yarn feeding surface, while in FIGS. 11 and 12, with the minimum diameter. In FIGS. 13 and 14, there is shown the position of the elastic band 12 in the embodiment in which the yarn feeding roller 8 incorporates the helical slots 11 and has the maximum diameter of its yarn feeding surface, while in FIGS. 15 and 16, with the minimum diameter. In the upper portion of the yarn guide 13 (FIGS. 1, 17, and 18) there is a slot 49 intended for attaching the yarn guide 13 to the housing 1 of the device for feeding yarn.

The device for feeding yarn to a knitting machine according to the invention operates as follows.

Figure 2:
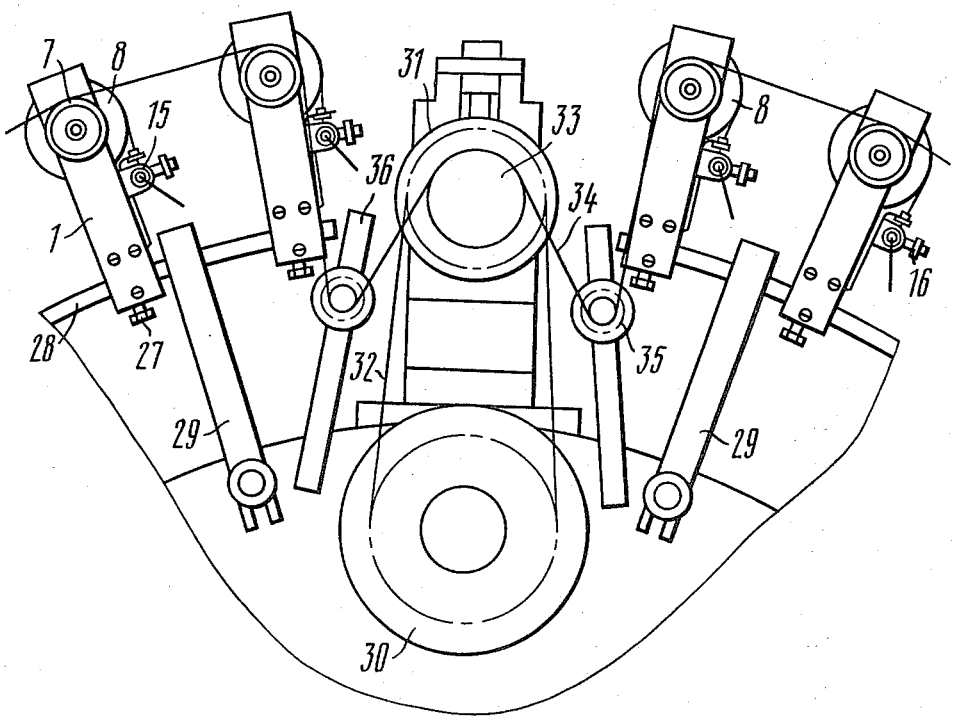
FIG. 2—is a top view of FIG. 1.

The yarn being wound off the spool of the knitting machine passes through the bushing 15 (FIG. 1), the yarn tensioner 14, the bushings 23 and 16 and is then wound on the yarn feeding roller 8 (FIG. 2). The yarn feeding roller 8 (FIG. 2) is brought in rotation from the variator 30 by transmitting motion from said variator 30 to the wedge belt 32, the pulleys 31 and 33, the perforated belt 34 and the drive pulley 7 fixed on the shaft 3 (FIG. 1). The desirable speed of motion of the perforated belt 34 (FIG. 2) and the drive pulleys 7, is equal for all of the devices for feeding yarn to the knitting machine, and is obtained by varying the diameter of the variator 30.

To ensure stability of the yarn feeding speed, a substantial number of yarn loops, e.g. ten to fifteen, are wound on the yarn feeding roller 8. The uniform spreading of yarn loops on the yarn feeding roller 8 is attained due to the manner in which the yarn loops envelop the surface of the yarn guide 13 (FIG. 1), the upper inclined portion thereof contributing to setting the yarn loops downward, while the lower portion, disposed parallel to the rotation axis of the yarn feeding roller 8, tightens the loops. Such a design of the yarn guide 13 enables the placement of the required number of yarn loops on the yarn feeding roller 8. The lower yarn loop, enveloping the yarn guide 13, passes through the bushings 24 and 26 and is directed to the needles of the knitting machine. The bushing 23 mounted on the lever 17 serves for the automatic shut-down of the knitting machine by shorting the circuit against the contact plate 19 in case the yarn tension is increasing or the yarn breaks on its entry to the yarn feeding roller 8. The bushing 24 mounted on the lever 18 serves for the automatic shut-down of the knitting machine by shorting the circuit against the plate 20 in case the yarn leaving the yarn feeding roller 8 breaks. When the machine is brought to a stop, the pilot lamp 22 light up. The speed of yarn feeding in various knitting systems of the machine can be changed by altering the diameter of the yarn feeding roller 8 when moving the elastic band along the slots 11.

According to one of the embodiments of the device, the elastic band 12 (FIGS. 3, 4 and 5) is transposed into the required annular slot 11 conforming to the speed of yarn consumption, which is accomplished by slackening the screws 37 and 42, detaching the discs 9 and 10 and locating the elastic band in the desirable slots 11, whereafter the discs 9 and 10 are attached by screws 37 and the screw 42 is threaded into the shaft 3, thus preventing the yarn feeding roller 8 from slipping off the shaft 3. The transmission of rotation from the shaft 3 to the yarn feeding roller 8 is effected by means of the pin 38 which are rigidly connected to the shaft 3 and fits in the slot 43 of the lower disc 9.

Should the need for disengaging the yarn feeding roller 8 from the drive arise, the roller 8 is lowered down until the pin 38 is disconnected from the slot 43. The spring ring 39 is then moved from the annular groove 41, intended for fixing the yarn feeding roller 8 on the shaft 3 in an operative position, to the annular groove 40 fixing the yarn feeding roller 8 in an non-operative position.

According to another embodiment of the invention (FIGS. 6, 7 and 8) the elastic band 12 is moved along the helical slots 11 for setting the required diameter of the yarn feeding roller 8 by means of rotating the lower disc 9 with respect to the upper disc 10. For this purpose, it is necessary to release the lug 46 from the slot 47 provided on the shaft 3, and from the slot 48 in the lower disc 9. Once the elastic band 12 is positioned in the helical slot or groove 11 of the required diameter, the slider 45 with the lug 46 is shifted back to the slots 47 and 48 rigidly connecting the yarn feeding roller 8 to the shaft 3. The ring washer 44 keeps the yarn feeding roller 8 from slipping off the shaft 3.

In order to obtain the maximum diameter of the yarn feeding roller 8 (FIGS. 9 and 10) incorporating the discs 9 and 10 with the annular slots 11, the elastic band 12 is transposed into the annular slot 11 having the maximum diameter. In order to obtain the minimum diameter of the yarn feeding roller 8 (FIGS. 11 and 12) of the specified design, the elastic band 12 is accordingly transposed into the annular slot 11 having the minimum diameter.

In order to obtain the maximum diameter of the yarn feeding roller 8 (FIGS. 13 and 14) incorporating the discs 9 and 10 with the helical slots 11, the elastic band 12 is shifted into the external turn of the helical slot 11. In order to obtain the minimum diameter of the yarn feeding roller 8 (FIGS. 15 and 16) of the specified design, the elastic band 12 is accordingly shifted into the internal turn of the helical slot 11 having the minimum diameter.

The intermediate values of the diameter of the yarn feeding roller 8 are provided similarly.

The mounting of the yarn guide 13 (FIGS. 1, 17 and 18) with respect to the surface of the yarn feeding roller 8 is accomplished by moving it along the housing 1 in the vertical and horizontal planes due to the provision of the slot 49.

The invention considerably simplifies the design of the device for feeding yarn to a knitting machine and, at the same time, improves the operational reliability of the device and reduces the bulk of its rotating components.

The extensive range of yarn feeding speeds obtainable in the device without any sophisticated appurtenances whatsoever makes it possible to expand the operational potentialities of the knitting machine as well as simplifying its operation, and therefore increasing the output of the knittng machine while manufacturing knitwear having intricate weave patterns, which require in production different levels of yarn consumption in various multifeed knitting systems.

From the specific embodiments of the present invention disclosed in the foregoing description, it shall become apparent to those skilled in the art that all of the objects of the invention are achievable within the scope defined by the appended claims. The embodiments of the invention described hereinabove are not to be interpreted as limiting the invention and have been presented merely as illustrative examples. It is clearly understood that minor modifications and variations can be introduced into the structure of the device without departing from the scope thereof.

All such modifications and variations are considered to be well within the scope of the invention defined by the appended claims.

What is claimed is:

1. A device for feeding yarn to a knitting machine, comprising:

a shaft rotatably mounted in a housing;

a drive pulley mounted on said shaft for rotating said shaft;

two spaced apart discs mounted on said shaft;

slots in said discs on the sides facing each other and arranged symmetrically in relation to a plane perpendicular to the axis of said shaft;

an elastic band positioned between said discs in the respective opposing slots;

said discs and said elastic band defining a yarn feeding roller, wherein the elastic band serves as a yarn feeding surface with a variable diameter on moving the elastic band along the slots of the discs; and a yarn guide mounted in a stationary position in relation to said yarn feeding roller and spaced therefrom;

said yarn guide being in the form of a rod having its upper portion disposed at an angle to the rotational axis of the yarn feeding roller, and its lower portion disposed parallel to this axis, whereby a change in the speed of feeding yarn and the uniformity of its tension depends on a change in the diameter of the roller.

2. A device according to claim 1, wherein said slots are in the form of concentric annular grooves.

3. A device according to claim 1, wherein said slots are helical grooves having a pitch between turns of about 0.3 to 0.5 mm.

* * * * *